US008470734B2

(12) United States Patent
Stork et al.

(10) Patent No.: US 8,470,734 B2
(45) Date of Patent: Jun. 25, 2013

(54) THERMOSENSITIVE RECORDING MATERIAL

(75) Inventors: Gerhard Stork, Flensburg (DE); Annette Schreiber, Kosel (DE); Svenja Eisernitz, Flensburg (DE); Falk Jahns, Flensburg (DE)

(73) Assignee: Mitsubishi HiTec Paper Europe GmbH, Flensburg (DE)

( * ) Notice: Subject to any disclaimer, the term of this patent is extended or adjusted under 35 U.S.C. 154(b) by 580 days.

(21) Appl. No.: 12/601,380

(22) PCT Filed: Jul. 9, 2009

(86) PCT No.: PCT/EP2009/058764

§ 371 (c)(1),
(2), (4) Date: Nov. 23, 2009

(87) PCT Pub. No.: WO2010/112088

PCT Pub. Date: Oct. 7, 2010

(65) Prior Publication Data

US 2011/0237432 A1 Sep. 29, 2011

(30) Foreign Application Priority Data

Apr. 3, 2009 (DE) ..... 10 2009 0161082

(51) Int. Cl.
*B41M 5/333* (2006.01)

(52) U.S. Cl.
USPC ..... 503/216; 503/200; 503/226

(58) Field of Classification Search
None
See application file for complete search history.

(56) References Cited

U.S. PATENT DOCUMENTS

| | | | | |
|---|---|---|---|---|
| 6,846,619 | B2 * | 1/2005 | Kaneko et al. | 430/338 |
| 2003/0060366 | A1 | 3/2003 | Kaneko et al. | |
| 2004/0235660 | A1 | 11/2004 | Iwasaki et al. | |
| 2005/0221982 | A1 * | 10/2005 | Taylor et al. | 503/216 |

FOREIGN PATENT DOCUMENTS

| | | |
|---|---|---|
| DE | 40 37 299 | 12/1991 |
| DE | 102006050420 | 3/2008 |
| JP | 2003 276 334 | 9/2003 |
| WO | WO2009033589 | 3/2009 |
| WO | WO2009033590 | 3/2009 |

* cited by examiner

*Primary Examiner* — Bruce H Hess
(74) *Attorney, Agent, or Firm* — Cozen O'Connor

(57) ABSTRACT

A heat-sensitive recording material includes a paper web with recycled fibers and a heat-sensitive recording layer includes color formers and color acceptors. The amount of recycled fiber contained in the paper web is at least 70 percent by weight, and the heat-sensitive recording layer has, as color acceptor, at least 33⅓ percent by weight of N-(p-toluenesulphonyl)-N'-3-(p-toluenesulphonyloxyphenyl)urea in relation to the total content of color acceptors in the heat-sensitive recording layer.

15 Claims, No Drawings

THERMOSENSITIVE RECORDING MATERIAL

PRIORITY CLAIM

This is a U.S. national stage of application No. PCT/EP2009/058764, filed on Jul. 9, 2009. Priority is claimed on the following application: Country: Germany, Application No.: 10 2009 016 108.2, Filed: Apr. 3, 2009; the content of which is/are incorporated here by reference.

FIELD OF THE INVENTION

The present invention is directed to a heat-sensitive recording material comprising a paper web with recycled fibers and a heat-sensitive recording layer containing color formers and color acceptors. The present invention is further directed to the use of the proposed heat-sensitive recording material as a ticket or fare receipt.

BACKGROUND OF THE INVENTION

Heat-sensitive recording materials on paper webs have been known for many years and are steadily gaining in popularity. This may be explained by the fact that their use as tickets in particular offers great advantages to ticket suppliers. Because the color-forming components in the heat-sensitive recording process reside in the recording material itself, it is possible to employ large numbers of printers which operate without toner or ink cartridges and whose function need no longer be monitored by persons at regular intervals. Accordingly, this innovative technology has had extensive success particularly in public transportation, busses and rail transportation, air travel, stadium and museum ticket kiosks, and parking receipt dispensers.

There have been numerous attempts to improve the known heat-sensitive recording materials, particularly for economizing on resources for environmental reasons. One such attempt consists in the use of recycled fibers in the paper web substrate for the recording layer. For example, DE-C-40 37 299 discloses the fundamental suggestion to use a coating base paper whose fiber content is made up of at least 95 percent by weight of recovered paper. However, this reference does not address the problems arising from the use of recovered paper with regard to background darkening and resistance over time of print images formed by the supply of heat.

To remedy the problems left unsolved by DE-C-40 37 299, it is proposed in EP-B-1 413 452 to use 4-hydroxybenzenesulfone anilide as acceptor in the heat-sensitive recording layer. Without doubt, this reference represents a great improvement in the use of paper webs with recycled fibers because it was able to overcome the considerable disadvantages arising from the low stability of 2,2-bis(4-hydroxyphenyl)propane (bisphenol A), which is explicitly mentioned therein, as an acceptor in heat-sensitive recording layers.

With knowledge of the prior art referenced herein, it was an object of the invention to provide a substantial improvement in an alternative heat-sensitive recording material with a paper web having recycled fibers with respect to the resistance of print images formed by the supply of heat relative to oils, plasticizers, as well as heat. It is precisely these resistances which are particularly important for the intended use of the heat-sensitive recording material suggested herein as tickets. Another important focus is the whiteness of the recording layer because a gray recording layer causes errors in character recognition; further, grayish recording materials used as tickets are not deemed acceptable commercially.

SUMMARY OF THE INVENTION

The above-stated object is met according to the present invention by providing a heat-sensitive recording material comprising:

- a paper web with recycled fibers, and
- a heat-sensitive recording layer containing color formers and color acceptors, wherein
- the amount of recycled fiber contained in the paper web is at least 70 percent by weight with respect to the total fiber content in the paper web, and
- the heat-sensitive recording layer has, as color acceptor, at least 33⅓ percent by weight of N-(p-toluenesulphonyl)-N'-3-(p-toluenesulphonyloxyphenyl)urea, commercially available as Pergafast® 201 from CIBA Specialty Chemicals Inc., in relation to the total content of color acceptors in the heat-sensitive recording layer.

N-(p-toluenesulphonyl)-N'-3-(p-toluenesulphonyloxyphenyl)urea can also be represented as a formula (1), wherein the two $CH_3$ end molecules are also often omitted in the literature:

Formula (1)

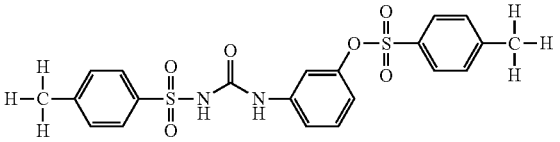

In addition to the proportion of recycled fibers at least 70 percent by weight of, the recording material according to the present invention can also comprise fresh pulp, preferably eucalyptus pulp. In a preferred embodiment, the paper web even has a proportion of recycled fibers of at least 85 percent by weight and, further, even 98 percent by weight to 100 percent by weight in relation to the total fiber content of the paper web.

The proportion of recycled fibers can be made up of one or more different types of recovered paper conforming to the European Standard EN 643 of December 2001. Those types of recovered paper included in Group IV, Higher Grades, as defined by CEPI are particularly suitable in this regard. In particular, these types include: 2.03/2.04—lightly or heavily printed white shavings, mainly made from wood pulp; 2.05—office papers; 2.07—books made from pulp; 2.09—carbonless copy paper; 2.10/2.11—PE-coated board; 3.01/3.02/3.04—shavings of printer paper and writing paper, partially woodfree, and pulp-containing tear shavings; 3.05/3.06—white writing papers and business papers; 3.14—white newsprint; 5.06/5.07—printed and unprinted wet-strength pulp papers. However, the invention is in no way limited to the above-mentioned types of recovered paper. The following types of recovered paper can also be used for the recycled fibers in the paper web: Group I—mixed grades, and Group III—newsprint and illustrated materials, as defined by CEPI. It is especially important in this case that a pigmented intermediate layer is situated between the paper web and the heat-sensitive recording layer at least for visual reasons, although an intermediate layer of this kind would not be considered technically required.

With respect to the recycled fibers used within the framework of the present invention, a fundamental distinction is made between "pre-consumer waste" and "post-consumer waste" depending on whether the recovered paper was collected before or after being used by the end consumer. Types of recovered paper having the highest possible pre-consumer proportion—quantitatively expressed: a pre-consumer portion of at least 70 percent by weight or, better, at least 90 percent by weight and, particularly preferably, 100 percent by weight—are especially preferred for the present invention. The percentages (absolutely dry) mentioned above refer to the fiber content of the recycled fibers. In practice, a uniform quality and composition of recycled fibers can only be ensured when the pre-consumer proportion is especially high. This is highly important for guaranteeing print images, which is increasingly demanded for commercial heat-sensitive recording materials.

In addition to the fiber content, the paper web contains one or more fillers. In this respect, a ratio of fiber to filler in percent by weight in a range of 15:1 to 2:1 or, 10:1 to 3:1, and particularly preferably 5:1 to 3:1, is considered to be especially suitable. Preferred fillers particularly include calcium carbonate, talc, and kaolin; other possible fillers include aluminum oxide and particularly boehmite, although the invention is not limited to the fillers mentioned above.

The paper web of the heat-sensitive recording material according to the invention preferably has a $Cobb_{60}$ value X, where 15 $g/m^2$<X<40 $g/m^2$ or, preferably, a $Cobb_{60}$ value X, where 15 $g/m^2$<X<35 $g/m^2$, on the side facing the heat-sensitive recording layer. The minimum $Cobb_{60}$ value is primarily determined by economical considerations and handling limitations with respect to paper webs of this kind. At $Cobb_{60}$ values above 40 $g/m^2$, an excessive penetration of the applied coatings into the paper has been observed, which detracts from the outward appearance of the suggested recording material and, in particular, leads to losses in the dynamic print density of the print images to be formed. Excessive penetration of the applied coatings into the paper web also means that greater amounts of coating must be applied, which also entails economical considerations. Trials in which the $Cobb_{60}$ value for the paper web on the side facing the heat-sensitive recording layer was limited to a maximum of 35 $g/m^2$ were particularly compelling with respect to dynamic print density.

The $Cobb_{60}$ values mentioned in the claims and in the specification within the framework of the present invention were determined in conformity with the procedures specified in DIN/EN 20535 and ISO 535 with distilled water at 20° C.

According to a first embodiment variant, the heat-sensitive recording layer of the heat-sensitive recording material according to the invention has two color acceptors, namely, N-(p-toluenesulphonyl)-N'-3-(p-toluenesulphonyloxyphenyl)urea, known as Pergafast® 201 by CIBA Speciality Chemicals Inc., and a urea-urethane compound according to Formula (2):

Formula (2)

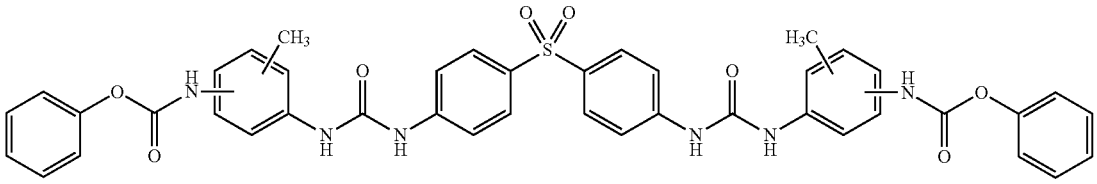

where the ratio of the two color acceptors, N-(p-toluenesulphonyl)-N'-3-(p-toluenesulphonyloxyphenyl)urea and the urea-urethane compound according to Formula (2), is in a range of 10:1 to 1:1 with respect to percent by weight in the heat-sensitive recording layer.

In a preferred embodiment form of this first variant, the ratio of the two color acceptors, N-(p-toluenesulphonyl)-N'-3-(p-toluenesulphonyloxyphenyl)urea and the urea-urethane compound according to Formula (2), is in a range of 5:1 to 2.5:1 with respect to percent by weight in the heat-sensitive recording layer.

To ensure a good contrast between characters induced by supplied heat and the blank recording layer, the recording layer in each of its embodiment forms and variants has a whiteness in a range of 77% to 85%, particularly preferably 79% to 85%, using light without UV content and a whiteness in the range of 84% to 93%, particularly preferably 87% to 93%, using light with UV content as measured by ISO 2469/ISO 2470. In order to ensure the important features of the whiteness of the recording material according to the invention in each of its preferred embodiment forms and variants, the paper web with the recycled fibers, possibly after glazing by a calender or calender stack, but before application of an optional pigmented intermediate layer as will be described below, preferably has a whiteness in a range of 72% to 85% using light without UV content, and a whiteness in a range of 78% to 99% using light with UV content, as measured by ISO 2469/ISO 2470, where a D65 illuminant is used at a viewing angle of 8°.

In order to achieve the desired degree of whiteness for the heat-sensitive recording layer, it is necessary in case of the first embodiment variant which contains two color acceptors as described above, that the urea-urethane compounds according to formula (2) are heated to 60° C. before mixing them with the other color acceptor and/or with other components of the heat-sensitive recording layer and that this heating is continued without interruption for 24 hours.

Based on the total weight of the recording layer, the two color acceptors, N-(p-toluenesulphonyl)-N'-3-(p-toluenesulphonyloxyphenyl)urea and the urea-urethane compound according to formula (2), can account for up to 35 percent by weight, but preferably a proportion in a range from 20 to 30 percent by weight, of the heat-sensitive recording layer. The mixture of the two color acceptors has a combined effect resulting from the properties of the two individual color acceptors: while N-(p-toluenesulphonyl)-N'-3-(p-toluenesulphonyloxyphenyl)urea was recognized after numerous individual tests and cross-tests as a color acceptor promising a high sensitivity of the heat-sensitive recording layer to the effects of energy, urea-urethane compounds according to formula (2) may be described rather as color acceptors in which the print image induced by the effect of energy has a particularly high degree of stability relative to the ingredients of the recovered paper used in the paper web and relative to environmental influences. When the two color acceptors are used in the recording layer in a mixture ratio according to the present invention, the result is a highly responsive heat-sensitive recording material which has very little tendency toward background darkening and has a heat-induced print image that is very stable relative to environmental influences.

According to a second embodiment variant, the heat-sensitive recording layer of the heat-sensitive recording material according to the present invention also has, in addition to N-(p-toluenesulphonyl)-N'-3-(p-toluenesulphonyloxyphenyl)urea, known as Pergafast® 201 by CIBA Specialty Chemicals Inc., an isocyanate component and an imino component reacting with this isocyanate component as color acceptors for color-forming reaction with the color formers such as the below described anilinoflurans and phthalides, wherein the isocyanate component and the imino component together form an anti-fade system.

Possible isocyanate components are in particular those selected from the list comprising: 2,6-dichlorophenyl isocyanate, p-chlorophenyl isocyanate, 1,3-phenylene diisocyanate, 1,3-dimethylbenzene-4,6-diisocyanate, 1,4-dimethylbenzene-2,5-diisocyanate, 1-methoxybenzene-2,4-diisocyanate, 1-methoxybenzene-2,5-diisocyanate, 1-ethoxybenzene-2,4-diisocyanate, 2,5-dimethoxybenzene-1,4-diisocyanate, 2,5-diethoxybenzene-1,4-diisocyanate, azobenzene-4,4'-diisocyanate, diphenylether-4,4'-diisocyanate, naphthalene-1,4-diisocyanate, naphthalene-1,5-diisocyanate, naphthalene-1,6-diisocyanate, naphthalene-2,6-diisocyanate, naphthalene-2,7-diisocyanate, 3,3'-dimethylbiphenyl-4,4'-diisocyanate, 3,3'-dimethoxy-biphenyl-4,4'-diisocyanate, diphenylmethane-4,4'-diisocyanate, diphenyldimethylmethane-4,4'-diisocyanate, benzophenone-3,3'-diisocyanate, fluorene-2,7-diisocyanate, anthraquinone-2,6-diisocyanate, 9-ethylcarbazole-3,6-diisocyanate, pyrol-3,8-diisocyanate, naphthalene-1,3,7-triisocyanate, biphenyl-2,4,4'-triisocyanate, and particularly 4,4',4"-triisocyanate-2,5-dimethoxytriphenylamine, p-dimethylaminophenylisocyanate, and tris(4-phenylisocyanate)thiophosphate.

The imino component is preferably 3-amino-4,5,6,7-tetrachloro-1-imino-1-indole.

The ratio of isocyanate components to imino components with respect to absolutely dry parts by weight is preferably in the range of 1:5 to 5:1, preferably, 1:1.5 to 1.5:1. The best results were achieved with a balanced ratio between isocyanate components and imino components.

The ratio of anti-fade color system components to the components of the leuco dye system, i.e., N-(p-toluenesulphonyl)-N'-3-(p-toluenesulphonyloxyphenyl)urea, as color acceptor, and the dye precursors reacting with this color acceptor is preferably in a range between 1:5 and 1:16.5, preferably between 1:9 and 1:14, most preferably between 1:10.5 and 1:12.5 based on absolutely dry parts by weight.

According to a third embodiment variant, the heat-sensitive recording layer of the heat-sensitive recording material according to the invention has, as color acceptor, exclusively N-(p-toluenesulphonyl)-N'-3-(p-toluenesulphonyloxyphenyl)urea, known as Pergafast® 201 by CIBA Specialty Chemicals Inc. The color acceptor then accounts for up to 32 percent by weight, but preferably a proportion in a range between 18 and 30 percent by weight, and more preferably, between 20 and 28.5 percent by weight, of the total weight of the heat-sensitive recording layer.

As color formers in the heat-sensitive recording layer, the heat-sensitive recording material preferably has those selected from the list comprising: 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran and 3-(N-ethyl-N-tetrahydrofuryl)amino-6-methyl-7-anilinofluoran.

It is possible for the heat-sensitive recording layer to have more than one color former selected from the color formers listed above. But, in addition to these substances specified as color formers, the recording material according to the invention can also contain one or more of the following compounds which are absorbent in the near infrared range:

3,6-Bis(dimethylamino)fluorene-9-spiro-3'-(6'-dimethylaminophthalide), 3-diethylamino-6-dimethylaminofluorene-9-spiro-3'-(6'-dimethylaminophthalide), 3,6-bis(diethylamino)-fluorene-9-spiro-3'-(6'-dimethylaminophthalide), 3-dibutylamino-6-dimethylaminofluorene-9-spiro-3'-(6'-dimethylaminophthalide), 3-dibutylamino-6-diethylaminofluorene-9-spiro-3'-(6'-dimethylaminophthalide), 3,6-bis(dimethylamino)fluorene-9-spiro-3'-(6'-diethylaminophthalide), 3-diethylamino-6-dimethylaminofluorene-9-spiro-3'-(6'-diethylaminophthalide), 3-dibutylamino-6-dimethylaminofluorene-9-spiro-3'-(6'-diethylaminophthalide), 3,6-bis-(di-ethylamino)fluorene-9-spiro-3'-(6'-diethylaminophthalide), 3,6-bis-(dimethylamino)-fluorene-9-spiro-3'-(6'-dibutylaminophthalide), 3-dibutylamino-6-diethylaminofluorene-9-spiro-3'-(6'-diethylaminophthalide), 3-diethylamino-6-dimethylaminofluorene-9-spiro-3'-(6'-dibutylaminophthalide), 3,3-bis[2-(4-dimethylamino-phenyl)-2-(4-methoxyphenyl)-ethenyl]-4,5,6,7-tetrachlorophthalide.

To increase thermal responsiveness, the recording layer of the heat-sensitive recording material according to the present invention can preferably also contain sensitizers, ideally with a melting point of 60° C. to 180° C., particularly preferably with a melting point of 80° C. to 140° C. Examples of sensitizers of this type are: benzyl-p-benzyloxy-benzoate, stearamide, N-methylolstearamide, p-benzylbiphenyl, 1,2-di(phenoxy)-ethane, 1,2-di(m-methylphenoxy)ethane, m-terphenyl, dibenzyloxalate, benzyl naphthyl ether, and diphenyl sulfone. Benzyl naphthyl ether, diphenyl sulfone, 1,2-di(m-methylphenoxy)ethane, and 1,2-di(phenoxy)-ethane are preferred.

Further, another particularly preferred sensitizer is 2-2-(2H-benzotriazol-2-yl)-p-cresol according to the following formula (3):

Formula (3)

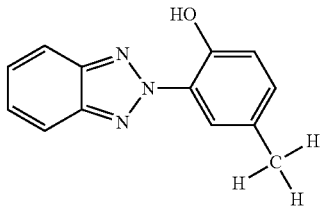

2-(2H-Benzotriazol-2-yl)-p-cresol according to formula (3), which is commercially available as Tinuvin® from CIBA Speciality Chemicals Inc., can be used by itself or in combination with the sensitizers mentioned above in the recording layer of the recording material according to the present invention.

Suitable binders for incorporating in the heat-sensitive recording layer are, for example, water-soluble binders such as starch, hydroxy ethyl cellulose, methyl cellulose, carboxy methyl cellulose, gelatins, casein, polyvinyl alcohols, modified polyvinyl alcohols, sodium polyacrylates, acrylamide/acrylate copolymers, acrylamide/acrylate/methacrylate terpolymers, alkali salts of styrene maleic acid anhydride copolymers or ethylene maleic acid anhydride copolymers, alone or in combination; also, water-insoluble latex binders such as styrene-butadiene copolymers, acryl nitrile butadiene copolymers, and methyl acrylate butadiene copolymers can be used as binders for incorporation in the heat-sensitive recording layer. Within the meaning of the present invention, polyvinyl alcohol in combination with acrylate copolymers are preferred binders and are together incorporated in the heat-sensitive recording layer in a range of 9 to 25 percent by weight with respect to the total weight of the recording layer.

To prevent sticking to a thermal head and to prevent excessive wear of the thermal head, the coating compound for forming the heat-sensitive recording layer can also contain lubricants and release agents such as metal salts of higher fatty acids, for example, zinc stearate and calcium stearate, and waxes such as, e.g., paraffin, oxidized paraffin, polyethylene, polyethylene oxide, stearamide, and castor wax. Other constituents of the recording layer are, for example, pigments, preferably inorganic pigments such as, for example, aluminum (hydr)oxide, silicic acid, and calcium carbonate. Calcium carbonate which is preferably incorporated in the recording layer in a quantity from 10 to 28 percent by weight based on the total weight of the recording layer is preferred.

Roll doctor coating units, knife coating units, curtain coaters, or air brushes can be used in particular as coating devices for applying the heat-sensitive recording layer. According to a preferred embodiment, the coating compound used to form the recording layer is aqueous. The subsequent drying of the coating compound is usually carried out by a process in which heat is supplied such as by hot air floatation dryers or contact dryers. A combination of the aforementioned drying methods has also proven successful. The mass per unit area of the heat-sensitive recording layer is preferably between 2 $g/m^2$ and 6 $g/m^2$ or, preferably, between 2.3 $g/m^2$ and 5.8 $g/m^2$.

A pigmented intermediate layer is suitably arranged between the heat-sensitive recording layer and the paper web of the heat-sensitive recording material according to the invention. Further, when the intermediate layer is applied in a preferred embodiment with leveling coating devices such as, e.g., roll coating units, coating blade units, or (roll) doctor coating units, the intermediate layer can contribute in a positive manner to the leveling of the paper web surface so that the required amount of coating compound to be applied for the heat-sensitive recording layer is reduced. A preferred range of 5 $g/m^2$ to 20 $g/m^2$ or, preferably, 7 $g/m^2$ to 12 $g/m^2$ for the mass per unit area of the intermediate layer has proven successful.

When the intermediate layer situated between the recording layer and the paper web contains inorganic, oil-absorbing pigments, these pigments can absorb the wax constituents of the heat-sensitive recording layer which are liquefied by the heating effect of the thermal head during formation of the print and accordingly promote an even more reliable and faster functioning of the heat-induced recording, which is why an embodiment of this kind is preferred.

It is particularly advantageous when the pigments of the intermediate layer have an oil absorption of at least 80 $cm^3$/100 g or, preferably, 100 $cm^3$/100 g as defined by the Japanese standard JIS K 5101. Calcined kaolin has proven particularly successful by reason of the large absorption reservoir in its voids. However, the following inorganic pigments have also proven to be very well-suited as constituents of the intermediate layer: silicon oxide, bentonite, calcium carbonate, aluminum oxide and, particularly for this purpose, boehmite. Mixtures of a plurality of different inorganic pigments are also conceivable.

Tests have shown that it can also be very advantageous to incorporate organic pigments in the pigmented intermediate layer. The reason for this is that organic pigments of this kind are highly conducive to a high heat reflectivity of the intermediate layer. The organic hollow pigments, as they are called, which are arranged in an intermediate layer of a heat-sensitive recording material have air in their interior, which is a good heat insulator. The intermediate layer which is optimized in this way as a heat reflection layer enhances the responsiveness of the recording layer to heat, which appreciably increases the resolution of the heat-sensitive recording layer and particularly the dynamic print density so that the maximum printing speed of the thermal printer in the recording material according to the present invention is increased at the same time.

The quantitative ratio of organic to inorganic pigment is a compromise between the effects brought about by the two types of pigment, and one which is met in a particularly advantageous manner when the pigment mixture is composed of 5 to 30 percent by weight or, preferably, 8 to 20 percent by weight of organic pigment to 95 to 70 percent by weight or, more preferably, 92 to 80 percent by weight of inorganic pigment. Pigment mixtures of different organic pigments are also suitable.

In addition to the inorganic pigments and possibly organic pigments, the pigmented intermediate layer contains at least one binder, preferably based on a synthetic polymer. For example, styrene-butadiene latex delivers especially good results. The use of a synthetic binder with the addition of at least one natural polymer, preferably starch, represents a particularly suitable embodiment. Further, it was determined in tests with inorganic pigments that a particularly suitable embodiment is achieved with a binder to pigment ratio in the pigmented intermediate layer between 3:7 and 1:9 with respect to percent by weight.

When the heat-sensitive recording material provided herein is used as a ticket or fare receipt, it is often indispensable to coat the back side because tickets and fare receipts often carry user information on the back. This information ranges from general transportation information and commercial information to advertisements printed in multiple colors.

For the recording material proposed herein to meet the requirements for rear-side printing, the recording material according to the present invention preferably has a pigmented back coating. This back coating is applied to the side of the paper web remote of the heat-sensitive recording layer.

Calcium carbonate—preferably with a particle size in a colloidal range of 60%<2 μm to 90%<2 μm—and/or magnesium carbonate have proven particularly suitable as pigments in the back coating. The following pigments also proved convincing through positive results:

- natural and calcined kaolin, preferably in the colloidal particle size range of 60% to 90%<2 μm,
- clay, silicic acid, silicon oxide, the latter preferably with a mean particle size in a range from 6 to 10 μm,
- aluminum hydroxide and boehmite, the latter possibly with mean particle sizes up to 0.5 μm to 3 μm, but boehmite products with a mean particle size from 10 nm to 100 nm are particularly preferred,
- and especially talc with a preferred mean particle size of 1 μm to 10 μm.

Mixtures of pigments, particularly those mentioned herein, were successfully used in numerous experiments upon which the present invention is based.

It must be taken into consideration when forming the back coating that the front coating and back coating will influence one another through the paper web situated in the center. Accordingly, it is particularly advantageous when the back coating has, in addition to the pigments, in particular a polyurethane-based component with a crosslinking effect. An anionic polyurethane in aqueous solution (for example, Eka SP AP 29, Eka Chemicals AB, 32301 Düren) is preferable. Further, the back coating can contain binders, particularly starch, styrene-butadiene latex, and possibly carboxy methyl cellulose. It is also possible and preferable to mix different binders in, at times, sharply divergent mixture ratios. Further, optical brighteners, defoaming agents, and components for regulating viscosity are conventional additives depending on requirements.

The recording material according to the present invention can preferably have a protective layer for optimizing the resistance of the recording material, according to the invention, to environmental influences such as moisture and perspiration transferred to the recording material when tickets and fare receipts are handled by users. A protective layer of this kind is also helpful for ensuring improved printability particularly in offset printing processes. A particularly well-suited protective layer within the meaning of the invention contains at least one binder and a crosslinking agent reacting with this binder.

In a first preferred embodiment, the binder of the protective layer is a polyvinyl alcohol modified by carboxyl groups or silanol groups. A protective layer of this kind has a high affinity with preferred UV-crosslinking printing inks used in offset printing, which is a decisive contributing factor to ensure improved printability in offset printing. Further, mixtures of different polyvinyl alcohols modified by carboxyl groups or silanol groups can also be used.

Suitable crosslinking agents for the protective layer are particularly those selected from the following group: boric acid, polyamine, epoxy resin, dialdehyde, formaldehyde oligomers, epichlorohydrin resin, dimethyl urea, and melamine formaldehyde. Mixtures of different crosslinking agents are also suitable.

The ratio by weight percent of modified polyvinyl alcohol to crosslinking agent in the protective layer preferably ranges from 20:1 to 5:1, particularly preferably from 12:1 to 7:1.

Particularly good results were achieved when the protective layer contained an inorganic pigment in addition. It is especially recommended that the inorganic pigment is selected from the group including silicon dioxide, aluminum hydroxide, bentonite, calcium carbonate, and kaolin, or a mixture of these inorganic pigments. A ratio of pigment and aluminum hydroxide, which is particularly preferred for this purpose, to modified polyvinyl alcohol is adjusted within a range of 1:2 to 1:5 based on the respective weight-percent of pigment and polyvinyl alcohol in the protective layer.

In a second preferred embodiment, diacetone-modified polyvinyl alcohol is incorporated in the protective layer instead of silanol-modified polyvinyl alcohol. Mixture ratios of pigment, individually or in combination, selected from the group including silicon dioxide, aluminum hydroxide, bentonite, calcium carbonate and, particularly preferably, kaolin, to the diacetone-modified polyvinyl alcohol are adjusted within a range of 1:1 to 1:5 based on percent by weight of pigment and polyvinyl alcohol in the protective layer.

In another embodiment, an acrylate copolymer is incorporated in the protective layer instead of, or in addition to, the silanol-modified polyvinyl alcohol. Mixture ratios of pigment, individually or in combination, selected from the group including silicon dioxide, aluminum hydroxide, kaolin, calcium carbonate and, particularly preferably, bentonite, to the acrylate copolymer are adjusted within a range of 1:15 to 1:22 with respect to percent by weight of pigment and binder in the protective layer.

The recording material according to the present invention preferably has at least one security feature. The conventional security feature in the paper production industry is the watermark. Therefore, the watermark is also particularly preferred within the framework of the present invention. By watermark is meant generally a design produced in the paper by different paper thicknesses. A distinction is made between:

- true watermarks which are produced by a displacement (so-called light watermarks) or by an accumulation (so-called shaded watermark) of the fiber pulp using, for example, a dandy roll in the wire section of a paper machine,
- and facsimile, or so-called impressed, watermarks which are produced by embossing the paper while still wet in the press section of a paper machine.

The proposed invention is directed equally to the use of the heat-sensitive recording materials described above in all embodiment forms and embodiment variants as tickets and, particularly, as fare receipts.

The mass per unit area in percent by weight (Weight-%) indicated in the description and in the claims refers to absolutely dry weight.

The invention will be further illustrated with reference to the following examples:

To form a first paper web (A) for a heat-sensitive recording material according to the invention, a paper pulp comprising fibers with filler and water is placed in a blend chest. One hundred percent of the fiber is made up of pre-consumer recycled fibers of Group IV as defined by CEPI, i.e., higher grades, in particular recovered paper types 2.03/2.04—lightly or heavily printed white shavings, mainly wood pulp; 2.05—office papers; 2.07—pulp books; 2.09—carbonless copy paper; 3.01/3.02/3.04—shavings of printer paper and writing paper, partially woodfree, and pulp-containing tear shavings; 3.05/3.06—white writing papers and business papers. The printing inks in the pulp are separated by a de-inking process using the flotation method. The pulp is then reductively bleached by formamidinesulfinic acid (FAS). Finally, additional constituents of the pulp include resin size for internal sizing in quantities of 0.6 percent by weight (absolutely dry) based on the total weight of the pulp and, optionally, additional conventional additives such as, e.g., additional pigments and/or optical brighteners. The finished pulp is then fed to a Fourdrinier paper machine in which it is processed to form a paper web with a grammage of 69 g/m$^2$.

To form two additional paper webs (B, C) for the heat-sensitive recording material according to the invention, the fibers used comprise 5% post-consumer recycled fibers in the first instance (paper web B) and 15% post-consumer recycled fibers in the second instance (paper web C) in addition to the fibers comprising pre-consumer recycled fibers of Group IV as defined by CEPI. The percentages (absolutely dry) are based on the total proportion of fiber material. The rest of the production parameters for the paper webs (B, C) are identical to the production parameters for paper web (A).

As a limit case of the present invention, another paper web (D) produced from 100% post-consumer recycled fibers of Group I, as defined by CEPI, has the same production parameters as paper webs (A).

After the four paper webs (A, B, C, D) are lightly calendered with the same linear pressure in each instance, the respective $Cobb_{60}$ value on the front side is determined at values of 18.5 g/m$^2$ (A), 20.5 g/m$^2$ (B), 19.7 g/m$^2$ (C), and 225 g/m$^2$ (D). Additional measurements, particularly the whiteness of the paper webs, are given in Table 1.

TABLE 1

| Paper web | A | B | C | D |
|---|---|---|---|---|
| Fibers | 100% pre-consumer recycled fibers of Group IV | 95% pre-consumer recycled fibers of Group IV; 5% post-consumer recycled fibers | 85% pre-consumer recycled fibers of Group IV; 15% post-consumer recycled fibers | 100% post-consumer recycled fibers |
| $Cobb_{60}$ value | 18.5 g/m$^2$ | 20.5 g/m$^2$ | 19.7 g/m$^2$ | 225 g/m$^2$ |
| White with $UV_{D65, 8°}$ | 97.5% | 80.8% | 81.7% | 51.8% |
| Ratio $Fiber_{Total}$: Pigment | 4.98:1 | 4.91:1 | 4.52:1 | 4.65:1 |

An intermediate layer with a mass per unit area of 9 g/m$^2$ is applied to the front side of all four paper webs (A, B, C, D) using a roll doctor. The coating compound for forming the intermediate layer has:

- a pigment mixture of hollow pigment and calcined kaolin with a ratio of hollow pigment to calcined kaolin of 1:4 with respect to percent by weight,
- styrene-butadiene latex as binder,
- starch as co-binder
- and additional additives.

A heat-sensitive recording layer with a respective mass per unit area of 4.2 g/m$^2$ is applied to this pigmented intermediate layer by a roll doctor coating device. The aqueous coating compounds used for this purpose contain the following components according to the recipes given in Table 2:

- color former: 3-dibutylamino-6-methyl-7-anilinofluoran, i.e., ODB-2;
- color acceptor 1: N-(p-toluenesulphonyl)-N'-3-(p-toluenesulphonyl-oxyphenyl)urea, i.e., Pergafast® 201;
- color acceptor 2: 2,2-bis(4-hydroxyphenyl)propane, i.e., bisphenol A;
- sensitizer: benzyl naphthyl ether, i.e., BNE;
- binder: polyvinyl alcohol;
- co-binder: acrylate copolymers;
- pigment: calcium carbonate.

TABLE 2

| | Coating compound 1 (according to the invention) | | Coating compound 2 (comparison) | |
|---|---|---|---|---|
| | Component | Weight-% | Component | Weight-% |
| Color former | ODB-2 | 9 | ODB-2 | 8 |
| Color acceptor | Pergafast ® 201 | 20 | bisphenol A | 21 |
| Sensitizer | BNE | 20 | BNE | 21 |
| Binder | polyvinyl alcohol | 11.5 | polyvinyl alcohol | 10 |
| Co-binder | | | acrylate copolymers | 14 |
| Pigment | calcium carbonate | 25 | calcium carbonate/ | 17 |
| Additive | lubricant (zinc stearate), wax, crosslinking agents | 14.5 | lubricant (zinc stearate), wax, crosslinking agents | 9 |

The resulting four sample webs, according to the present invention, of the four paper webs (A, B, C, D) with the applied pigmented intermediate layer and heat-sensitive recording layer of coating compound 1 are analyzed in the same way as the four comparison sample webs of the four paper webs (A, B, C, D) with the applied pigmented intermediate layer and heat-sensitive recording layer of compound 2 with respect to whiteness of the recording layer and resistance to oils, plasticizers and heat.

The whiteness of the recording layer was determined using light with and without UV content. The measurements were carried out in conformity with the guidelines specified by ISO 2469/ISO 2470. However, D65 illuminant is used at a viewing angle of 8°. An Elrepho 2000 device is used for all of the whiteness measurements carried out according to this publication.

In order to measure the resistance of a thermal test copy in percentage, black-and-white checkered thermal test copies are made from the sample webs and comparison sample webs with an Atlantek 400 model by Printrex (USA). A thermal head with a resolution of 300 dpi and energy per unit surface area of 16 mJ/mm$^2$ was used. For each individual determination of resistance of a thermal test copy in percentage, the print density of the black-colored areas on a thermal test copy is first measured at three locations with a Gretag MacBeth, model D19C NB/U densitometer (Gretag MacBeth, 8105 Regensdorf, Switzerland). The thermal test copy is then treated.

In order to determine resistance to oil in percentage, this treatment consists in immersing the thermal test copy in an oil bath (Mazola corn oil, Unilever Deutschland GmbH, 20457 Hamburg) at 23° C. oil temperature for 20 minutes. Next, the copy is carefully swabbed off with blotting paper and then left undisturbed for 4 hours at 23° C. and 50% humidity.

After this interval, the print density is again determined at three locations on the black-colored areas with a Gretag MacBeth model D19C NB/U densitometer. The measurements made before and after the treatment, i.e., before and after the oil bath, are averaged, and the mean value after the bath is correlated in percentage to the mean value before the bath.

To determine aging stability, a thermal test copy is exposed to dry heat following the averaging of the print density of the black-colored areas with the Gretag MacBeth model D19C NB/U densitometer. Accordingly, in this case the treatment involves hanging the thermal test copy in a circulating air drying cabinet for 7 days at 60° C.

After the treatment consisting in leaving the thermal test copy in the circulating air drying cabinet for 7 days, the print density is again determined at three locations on the black-colored areas with the Gretag MacBeth model D19C NB/U densitometer. The measurements before and after the treatment are averaged, and the mean value after treatment is correlated in percentage with the mean value before treatment.

For each individual determination of the resistance, expressed as percentage, of a thermal test copy to plasticizers, a piece of TESA tape (TESA®-Grafik-Film 57331) of approximately 10 cm length is first taped to a thermal test copy prepared by an Atlantek 400 by Printrex (USA). The print density of the black-colored areas is then immediately measured at three locations with the Gretag MacBeth model D19C NB/U densitometer. The copy is then left undisturbed for 24 hours at 23° C. and 50% humidity. After this interval, the print density is determined again at three locations of the black-colored areas with the Gretag MacBeth model D19C NB/U densitometer. The respective measurements before and after the period during which the treated copy is left at rest are averaged, and the mean value after the rest period is correlated with the mean value before the rest period.

The resulting measurements are shown in Table 3:

TABLE 3

| | Paper web A + coating compound 1 (particularly preferred) | Paper web B + coating compound 1 (preferred) | Paper web C + coating compound 1 (preferred) | Paper web D + coating compound 1 (according to the invention) |
|---|---|---|---|---|
| Whiteness with $UVD_{65,\ 8°}$ | 90.2% | 84.3% | 85.8% | 78.2% |
| Whiteness without $UVD_{65,\ 8°}$ | 80.4% | 77.5% | 78.5% | 74.0% |
| Resistance to oil (Mazola) | 94% | 81% | 87% | <100%*1 |
| Resistance to plasticizer (TESA ®-Grafik-Film 57331 tape) | 76% | 70% | 73% | 82% |
| Resistance to dry heat (60° C.) | 90% | 83% | 83% | 79% |

| | Paper web A + coating compound 2 (comparison) | Paper web B + coating compound 2 (comparison) | Paper web C + coating compound 2 (comparison) | Paper web D + coating compound 2 (comparison) |
|---|---|---|---|---|
| Whiteness with $UVD_{65,\ 8°}$ | 84.9% | 82.2% | 83.1% | 74.6% |
| Whiteness without $UVD_{65,\ 8°}$ | 75.8% | 75.0% | 75.9% | 70.4% |
| Resistance to oil (Mazola) | 22% | 18% | 18% | 51%*1 |
| Resistance to plasticizer (TESA ®-Grafik-Film 57331 tape) | 48% | 49% | 50% | 45% |
| Resistance to dry heat (60° C.) | 73% | 75% | 78% | 62% |

*1oil sheen, paper turns brown

The strict requirements for whiteness in the recording layer in a range from 77% to 85% using light without UV content and whiteness in a range from 84% to 93% using light with UV content are met only by the samples with the combinations of paper web A, B or C and coating compound 1; none of the comparison samples using coating compound 2 can begin to meet these requirements. The sample according to the invention with the combination of paper web D and coating compound 1 is distinctly better than the combination of paper web D with coating compound 2 carried out for comparative purposes, but requires definite compromises with respect to the strict requirements for whiteness.

As concerns the resistance values, the examples according to the invention with paper web D in combination with coating compound 1 are distinctly superior. The preferred examples with paper webs B and C combined, respectively, with coating compound 1, and the particularly preferred examples with paper web A combined with coating compound 1 are particularly clear.

The individual resistances are dramatically improved. Differences were determined, for example, between 18% (paper web C/coating compound 2) and 87% (paper web C/coating compound 1) in oil resistance, between 48% (paper web A/coating compound 2) and 76% (paper web A/coating compound 1) in plasticizer resistance, and between 73% (paper web A/coating compound 2) and 90% (paper web A/coating compound 1) in resistance to dry heat.

This shows an impressive superiority of the examples according to the present invention over the comparison examples.

The invention claimed is:

1. A heat-sensitive recording material comprising a paper web containing recycled fibers and a heat-sensitive recording layer comprising color formers and color acceptors; the amount of recycled fiber contained in said paper web being at least 70 percent by weight with respect to the total fiber content in said paper web, and said heat-sensitive recording layer comprising, as color acceptor, at least 33 ⅓% percent by weight of N-(p-toluenesulphonyl)-N'-3-(p-toluenesulphonyloxyphenyl)urea in relation to the total content of color acceptors in said heat-sensitive recording layer.

2. The heat-sensitive recording material according to claim 1, wherein said paper web has a proportion of recycled fibers of at least 98 percent by weight in relation to the total content of fiber in said paper web.

3. The heat-sensitive recording material according to claim 1, wherein said recycled fibers of said paper web have a pre-consumer content of at least 70 percent by weight.

4. The heat-sensitive recording material according to claim 1, wherein said recycled fibers of said paper web have a pre-consumer content of 100 percent by weight.

5. The heat-sensitive recording material according to claim 1, wherein said heat-sensitive recording layer contains as an additional color acceptor, a urea-urethane compound according to Formula (2):

Formula (2)

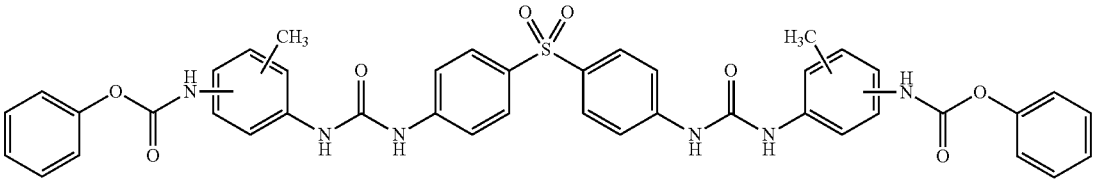

and wherein the ratio of the two color acceptors, is in a range of 10:1 to 1:1 with respect to percent by weight in said heat-sensitive recording layer.

6. The heat-sensitive recording material according to claim 1, wherein the color acceptor in said heat-sensitive recording layer consists of N-(p-toluenesulphonyl)-N'-3-(p-toluenesulphonyloxyphenyl)urea.

7. The heat-sensitive recording material according to claim 1, wherein said paper web has a $Cobb_{60}$ value X of 15 $g/m^2<x<40\ g/m^2$ on the side facing said heat-sensitive recording layer.

8. The heat-sensitive recording material according to claim 7, wherein said paper web has a $Cobb_{60}$ value X of 15 $g/m^2<x<35\ g/m^2$ on the side facing said heat-sensitive recording layer.

9. The heat-sensitive recording material according to claim 1, additionally comprising a pigmented intermediate layer formed between said paper web and said heat-sensitive recording layer.

10. The heat-sensitive recording material according to claim 9, wherein said pigmented intermediate layer comprises organic pigments and inorganic pigments, said inorganic pigments being selected from the list comprising calcined kaolin, silicon oxide, bentonite, calcium carbonate, aluminum oxide, and particularly boehmite.

11. The heat-sensitive recording material according to claim 1, wherein said heat-sensitive recording layer has a whiteness in a range from 77% to 85% using light without UV content as measured in conformity to ISO 2469/ISO 2470 using a D65 illuminant at a viewing angle of 8°.

12. The heat-sensitive recording material according to claim 1, wherein said color formers of the heat-sensitive recording layer are selected from the list comprising 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl)amino-6-methyl-7-anilinofluoran.

13. The heat-sensitive recording material according to claim 1, additionally comprising a protective layer applied to said heat-sensitive recording layer.

14. The heat-sensitive recording material according to claim 1, wherein said paper web additionally comprises a pigmented back coating on the side remote of said heat-sensitive layer.

15. The heat-sensitive recording material according to claim 1, wherein said paper web additionally comprises a watermark.

* * * * *